US006701721B1

(12) United States Patent
Berchowitz

(10) Patent No.: US 6,701,721 B1
(45) Date of Patent: Mar. 9, 2004

(54) STIRLING ENGINE DRIVEN HEAT PUMP WITH FLUID INTERCONNECTION

(75) Inventor: David M. Berchowitz, Athens, OH (US)

(73) Assignee: Global Cooling BV, Arnhem (NL)

( * ) Notice: Subject to any disclaimer, the term of this patent is extended or adjusted under 35 U.S.C. 154(b) by 0 days.

(21) Appl. No.: 10/356,135

(22) Filed: Feb. 1, 2003

(51) Int. Cl.[7] ..... F25B 9/00; F02G 1/04; F02G 1/043

(52) U.S. Cl. ..... 62/6; 62/324.6; 60/520; 60/521

(58) Field of Search ..... 62/6, 324.6; 60/520, 60/521

(56) References Cited

U.S. PATENT DOCUMENTS 3,858,802 A * 1/1975 Stobart ..... 237/12.1
4,345,437 A 8/1982 Dineen
4,361,008 A * 11/1982 Dineen ..... 60/521
4,404,802 A 9/1983 Beale
4,602,174 A 7/1986 Redlich
4,912,929 A * 4/1990 Chen et al. ..... 60/520
4,969,333 A * 11/1990 Osawa et al. ..... 62/6
4,996,841 A * 3/1991 Meijer et al. ..... 60/525
5,088,284 A * 2/1992 Momose ..... 60/517
5,383,334 A * 1/1995 Kaminishizono et al. ..... 60/517
5,638,684 A * 6/1997 Siegel et al. ..... 62/6
5,664,421 A * 9/1997 Matsue et al. ..... 62/6
5,967,488 A 10/1999 Redlich

* cited by examiner

*Primary Examiner*—William C. Doerrler
(74) *Attorney, Agent, or Firm*—Frank H. Foster; Kremblas, Foster, Phillips & Pollick

(57) ABSTRACT

A heat pumping machine, such as used for home heating and cooling, has a free piston Stirling engine driving a vapor compression heat pump. The engine is mechanically linked to the compressor inside a common hermetically sealed enclosure. A fluid conducting passage connects the refrigerant flow path in communication with a working gas space in the Stirling engine. Although carbon dioxide may be used in both as the refrigerant and the engine working gas, preferably both helium and carbon dioxide are used and separated by a phase separator so that helium rich gas is directed into the Stirling engine and carbon dioxide rich fluid is directed through the heat pump.

22 Claims, 3 Drawing Sheets

HEATING MODE

STIRLING ENGINE DRIVEN HEAT PUMP WITH FLUID INTERCONNECTION

BACKGROUND OF THE INVENTION

1. Field of the Invention

The invention is directed to heating and cooling apparatus, and more particularly to a Stirling engine as a prime mover driving the compressor of a vapor compression heat pump system for pumping heat from a cooler mass to a hotter mass.

2. Description of the Related Art

Vapor compression heat pumps are commonly used for heating homes or other buildings and for refrigeration and air conditioning. They are referred to as "heat pumps", whether the useful work is heating or cooling.

Most heat pumps are driven by electrical motors, which rely on electrical energy generated remotely from the heat pump site and carried by a transmission system to the site of the heat pump. The primary energy used to generate the electricity is commonly derived from a fuel, such as a hydrocarbon fuel, consumed at the generator site. Primary energy, which is not converted to electrical power at the generator site, and electrical energy converted to heat in the power distribution system both represent lost heat energy because that energy cannot be used to supply heat at the site of individual heat pumps. Therefore, this lost energy represents reduced fuel efficiency. For example, electrical power is usually generated at central power stations at a thermal efficiency of around 40% to 45%. This represents thermal power lost to the atmosphere at the generator site on the order of 55% to 60%. If additional distribution line losses are considered, by the time the electrical power is applied to drive a heat pump, the overall thermal efficiency of providing that electrical power may be only 30% to 35%.

If the primary energy is converted to mechanical energy at the heat pump site to drive a heat pump, then any energy, which is not converted into useful work for driving the heat pump can be used to heat the associated building, or for other useful purposes. Hydrocarbon fuels, such as petroleum products, wood, coal, and other biomass products, are commonly available and easily converted to heat. Heat pumps, which are driven by an engine capable of consuming such fuels have been used to achieve the result that heat energy not consumed to drive the heat pump is available for other purposes. Both internal combustion engines and heat driven, external combustion engines, such as Stirling engines, have been mechanically linked to heat pumps to achieve this goal.

For example, the waste heat from heat driven engines have been used to drive heat pumps which rely on the absorption cycle and use binary refrigerants (for example lithium bromide and water or ammonia and water) as the working medium. However, these absorption cycle systems have a significantly lower COP compared to vapor compression systems, and therefore are used principally where the heat source is free or waste heat. As known to those skilled in the art, COP is defined as the ratio of useful heat pumped to input power, both expressed in the same units of power.

Vapor compression heat pumps driven by an internal combustion engine, or by a Stirling engine, have also been used. The vapor compression systems have higher efficiencies and a better COP, but difficulties are encountered when they are coupled to a prime mover in the prior art manner. When these engines are used as prime movers, they are typically connected to the compressor of the vapor compression system by a mechanical drive link extending from the engine to the compressor. Since such links are typically exposed to or in communication with the atmosphere, they require seals to prevent leakage into the atmosphere. For example, a seal is required between a relatively moving drive shaft and its bearing.

Seals produce several undesirable consequences. Seals must be highly effective in maintaining the refrigerant in the system where it can perform its function and preventing any of the refrigerant from escaping as a pollutant into the atmosphere. Sealing has become particularly important since most refrigerants are implicated in health environmental concerns. Since the effectiveness of the sealing is so important, seals, which are sufficiently effective, are expensive and therefore can add considerably to the cost of the machine. Seals additionally introduce substantial friction losses because of the necessity of close, tight interfitting parts, and this friction reduces the efficiency of the machines. Seals are also subject to wear, which reduces the lifetime and reliability of the machine.

Since small internal combustion engines are noisy, of low efficiency and limited life, they have not been seriously considered for driving heat pumps for typical home heating systems. They also suffer the above sealing problems.

A Stirling engine, particularly a free piston Stirling engine, driving the compressor of a vapor compression system is a relatively efficient way to convert heat energy to mechanical energy for operating the compressor of a vapor compression system because a Stirling engine is an efficient way to convert heat energy to mechanical energy. However, typical prior art Stirling engine drive systems suffer from the sealing problems described above.

If a compressor and Stirling engine of the prior art were housed in a common, hermetically sealed enclosure to prevent leakage of gas into the atmosphere, the fluid refrigerant and the working gas of the Stirling engine would become intermixed, typically by engine working gas leaking between the interfacing piston and cylinder surfaces of the compressor into the refrigeration circuit. This would result in contamination of the fluids in one or both of the engine and heat pump, and a depletion of fluid in one of them, thus deteriorating or completely preventing its operation.

The prior art has made some attempts to overcome these sealing difficulties. For example, a Stirling engine may be coupled to the compressor by means of inertia. Others have attempted to use diaphragms which can provide hermetic sealing, but permit mechanical motion for driving the compressor. Diaphragm systems are illustrated in U.S. Pat. Nos. 4,345,437 and 4,361,008. However, diaphragm systems are difficult to implement and maintain because of the high pressures under which these systems operate and because leakage can result from repetitive flexure and work fatigue.

The prior art has used helium as the working gas in Stirling engines for a variety of reasons, particularly because it is efficient in converting the input heat energy to output mechanical energy of the Stirling engine.

The prior art has also recognized the desirability of using carbon dioxide as a refrigerant in a vapor compression heat pump system. Nonetheless, the Stirling engine systems as applied by the prior art, like the internal combustion systems, still suffer from the sealing difficulties described above.

It is therefore an object and feature of the present invention to provide a heat pumping system which can utilize a primary fuel on site and thereby avoid generation and power distribution losses, which can be hermetically sealed to avoid working or refrigerant fluid leakage without requiring a seal or a diaphragm, and which uses the highly efficient vapor compression system, operating either subcritical or trans-critical in a heat pump.

It is a further object and feature of the present invention to use a vapor compression heat pump, which attains the above result and further is capable of using carbon dioxide as a highly efficient refrigerant and helium as a highly efficient Stirling engine working gas to optimize operation of both the engine and the heat pump.

BRIEF SUMMARY OF THE INVENTION

The invention is a Stirling engine mechanically connected to the compressor of a vapor compression heat pump. They are connected both mechanically and by their internal working fluid systems and are enclosed together in a common, hermetically sealed enclosure to prevent refrigerant and Stirling working gas leakage into the atmosphere. No gas impermeable seal is required at the compressor piston or at an interconnecting drive rod connecting the piston to the Stirling engine, but, instead, the working fluid in the Stirling engine is permitted to leak past the compressor piston into the heat pump flow path and is then returned to the Stirling engine. The invention maintains the proper proportional quantities of both working fluid in the Stirling engine and refrigerant in the heat pump at operating equilibrium conditions. A single fluid, preferably carbon dioxide, can be used for both the Stirling engine working fluid and the refrigerant. Preferably, two fluids, most preferably carbon dioxide and helium, are used. When two fluids are used in the invention, a separator is positioned in the heat pump flow path to separate them. For example, the helium is separated from the carbon dioxide to provide a helium rich gas, which is transported through a fluid return line to the Stirling engine, and a carbon dioxide rich fluid, which remains in the heat pump as a refrigerant. Consequently, the efficiency of the Stirling engine and the COP of the heat pump are the high values associated with helium as a Stirling engine working gas and carbon dioxide as a refrigerant. Some intermixing is acceptable because carbon dioxide is also an acceptable working gas for the Stirling engine.

Preferably, the Stirling engine is a free piston Stirling engine. Also, preferably, the fluid return line, connecting the refrigerant flow path of the heat pump to the Stirling engine, is connected at one end to the heat pump flow path downstream of the expansion valve and upstream of the evaporator and is connected at the other end to the bounce space of the Stirling engine, which has a relatively constant pressure. This results in the Stirling engine average operating pressure being maintained approximately equal to the suction pressure of the heat pump.

As a result of the common hermetic enclosure combined with the return lines, the invention entirely eliminates the needs for seals, but, instead, gas leakage from the Stirling engine past the compressor piston of the heat pump and into the refrigeration system is returned to the Stirling engine.

Figure 1:
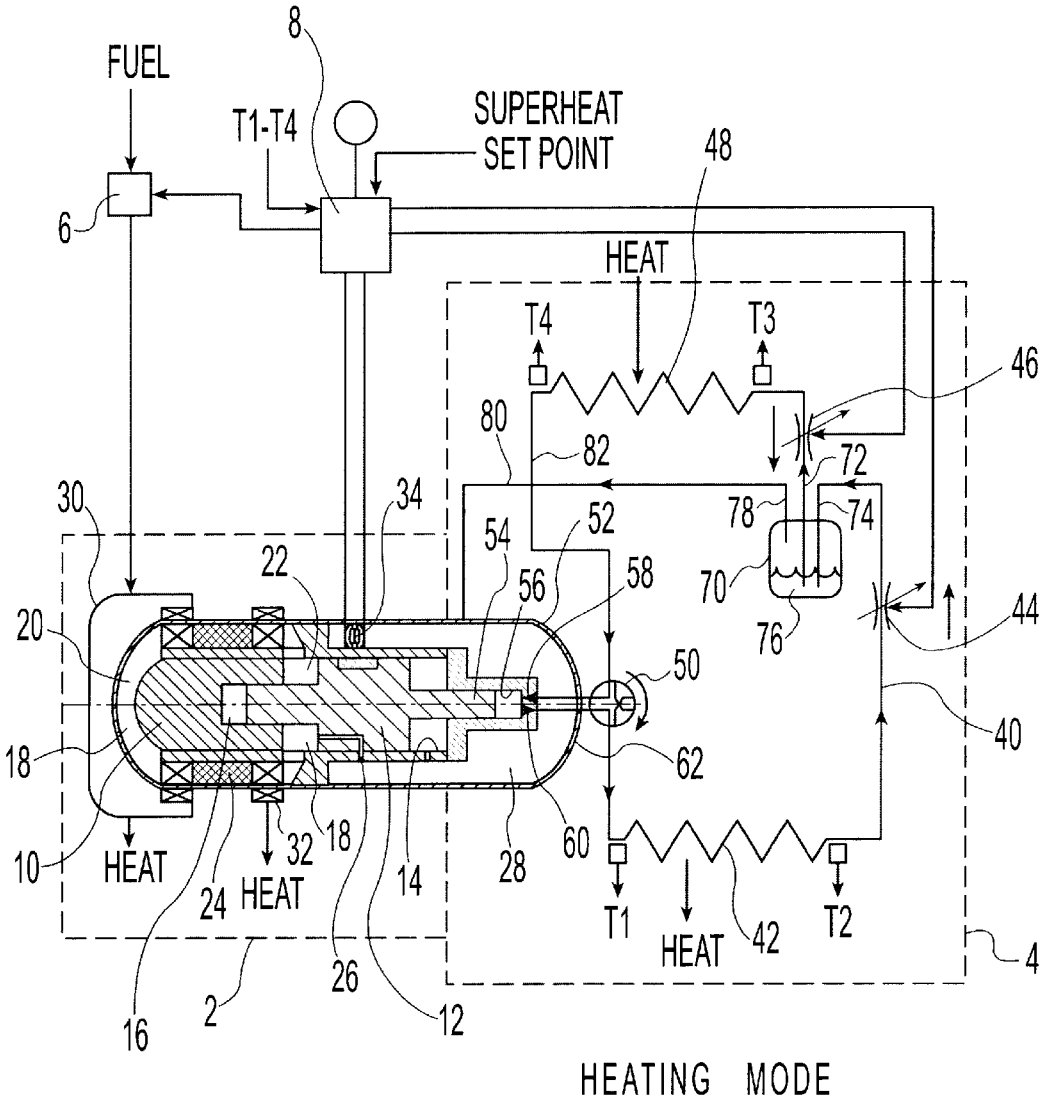
FIG. 1 is a schematic diagram of the preferred embodiment of the invention, operated in a heating mode.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other circuit elements where such connection is recognized as being equivalent by those skilled in the art.

DETAILED DESCRIPTION OF THE INVENTION

FIG. 1 illustrates a free piston Stirling engine 2, connected to a vapor compression heat pump 4. A controllable fuel valve 6 meters fuel to the Stirling engine 2, and the entire heat pumping system is controlled by a controller 8.

The Stirling engine 2 has components corresponding to the components in prior art free piston Stirling engines. These include a displacer 10 and a piston 12 slidably mounted in a cylinder 14. The displacer 10 is sprung to the piston 12 by a gas spring 16, but alternatively could be otherwise sprung, such as to a central, longitudinal rod, or in other ways known to those skilled in the Stirling engine art. As also known to those in the art, other springs, such as mechanical springs, can be used. The Stirling engine also has a workspace 18, which includes a hot space 20, connected in communication to a cold space 22, through a regenerator 24 in the conventional manner. A passage 26 includes a component through the piston 12 and a component through the cylinder 14 with ports at the interfacing piston and cylinder surfaces which register at the center position of the piston 12. The passage provides momentary communication between the workspace 18 and a bounce space 28 when the piston passes its center position for maintaining the center position of the piston, as described in Beale U.S. Pat. No. 4,404,802, which is herein incorporated by reference.

As known to those skilled in the art, a hydrocarbon fuel, typically a gas or liquid, enters the controllable fuel metering valve 6, and flows at a metered rate to a burner 30, preferably a recuperative burner, where combustion takes place and heat is transferred to the hot space 20, thus raising its temperature. Coolant circulates through a cold side heat exchanger 32, lowering the temperature in the cold space 22. The temperature differential between the hot space 20 and the cold space 22 causes the free piston Stirling engine 2 to produce power by causing the piston 12 to reciprocate, once motion is initiated, such as by a combination linear motor/alternator 34, or by other means known to those in the art.

The heat rejected from the free piston Stirling engine at the heat exchanger 32 and from the burner 30, as a result of burner inefficiency, may be used for supplying heat, such as to assist in heating a home or to provide hot water.

The vapor compression heat pump 4 has a refrigerant fluid contained in an endless flow path 40, which includes a heat exchanger 42, a controllable expansion valve 44, a controllable expansion valve 46, a heat exchanger 48, and a flow direction-reversing valve 50 connected to a compressor 52. The expansion valves are controllably variable for controlling the refrigerant flow rate.

When operated in the heating mode illustrated in FIG. 1, the heat exchanger 48 is an evaporator, so that it is a heat accepting heat exchanger, and the heat exchanger 42 is a heat rejecting heat exchanger. When operated subcritical, the heat rejecting heat exchanger is commonly termed a condenser. As will be seen, when operated in the cooling mode, illustrated in FIG. 2, the heat exchangers 42 and 48 interchange roles so that the heat exchanger 42 becomes heat accepting and the heat exchanger 48 becomes heat rejecting.

The compressor 52 includes a compressor piston 54, slidably mounted in a cylinder 56 and is provided in the conventional manner with a suction valve 58 and a discharge valve 60. Preferably, the power piston 12 of the Stirling engine 2 is integrally formed with the compressor piston 54, so that power from the reciprocating piston 12 is directly coupled to the compressor piston 54 for driving it in reciprocation. Consequently, the motion of the pistons is identical. The Stirling engine power piston 12 has a diameter greater than the diameter of the compressor piston 54 in order to match the cycle work of the free piston Stirling engine to the compressor.

As seen in FIG. 1, both the Stirling engine 2 and the compressor 52 are positioned within a common, hermetically sealed enclosure 62, which encloses both the engine and the compressor. Since the endless refrigerant flow path 40 and other connections to it are themselves hermetically sealed and hermetically connected to the common enclosure 62, the entire system is completely hermetically sealed from the atmosphere, preventing any escape of gas. There are no relatively sliding mechanical structures, which require sealing through which gas could escape to the atmosphere.

The expansion valves 44 and 46 are preferably forward-expanding, reverse-unimpeded expansion valves. Such a valve is shown in Redlich U.S. Pat. No. 5,967,488, which is herein incorporated by reference. A valve of this type has the properties that, in a forward direction of fluid flow through the valve, the flow is impeded, the valve forming an orifice, so that expansion occurs downstream of its "expansion end". In the opposite, reverse flow direction, flow is substantially unimpeded so there is no expansion associated with the valve in the reverse flow direction. Preferably, the valve has a controllable orifice or flow rate in the forward flow direction so that it operates in one flow direction as a controllable expansion valve and operates in the opposite flow direction substantially as an unimpeded, open conduit. In the Figures, an arrow beside the expansion valve indicates the direction of controllable flow for which expansion occurs downstream of the expansion valve. The expansion valves 44 and 46 are connected in the refrigerant flow path 40 between the heat exchangers 42 and 48 and are arranged in opposite directions or polarity. This means that for flow in either direction, one valve operates as an expansion valve and the other operates as a substantially unimpeded conduit.

The embodiment of FIG. 1 also has a gas/liquid phase separator 70, having a pair of fluid conducting lines 72 and 74, connecting the expansion side of each expansion valve 44 and 46 in fluid communication with a liquid containing portion 76 of the separator 70. The separator 70 also has a gas phase outlet 78 connected to a fluid conducting passage 80, which in turn is connected in communication with at least one of the Stirling engine spaces and preferably the bounce space 28. As will be seen from a description of the operation of the invention, the passage 80 returns to the Stirling engine, preferably to its bounce space 28, a working gas which had previously leaked between the compressor piston 54 and compressor cylinder 56 into the refrigerant flow path 40, and was separated in the gas separator 70 from the refrigerant.

The conducting of fluid from the heat pump back into the Stirling engine is important not only for separating the two fluids in the case of a dual fluid or multi-fluid system in order to maximize efficiency, but also is necessary in order to maintain the proper operating pressure charge of working fluid within the Stirling engine. Leakage of fluid past the piston represents not only a potential contamination of the heat pump, but also represents a depletion of working gas from the Stirling engine. Continued depletion of working gas from the Stirling engine not only reduces its efficiency, but eventually could cause improper operation, damage or collisions within the engine.

Stirling engines and vapor compression heat pump systems operate utilizing fluids, a working gas for a Stirling engine and a refrigerant for the heat pump. A variety of different fluids have been used for both systems. The choice of fluids for use in any system, including the system with the present invention, is dependent upon a variety of factors and engineering choices, including minimum standards to obtain operation, the efficiency of the operation and the temperatures at which the various components of the systems will be operating. Although there are multiple fluid choices available for use in embodiments of the present invention, these criteria result in strong preferences when selected for embodiments of the invention intended for use in a home heating system.

Furthermore, embodiments of the invention may be operated using a single fluid for both the Stirling working gas and the refrigerant. Alternatively, and preferably because of improved efficiency, two fluids are used, one chosen for Stirling engine efficiency, the other chosen for heat pumping efficiency, and both chosen for compatibility within embodiments of the invention. One criterion for a fluid used in the present invention is that it must be in vapor or gas form at any temperature and pressure condition within the Stirling engine because there should be no liquid phase within the Stirling engine. A fluid chosen for operation as the refrigerant in the vapor compression heat pump must have properties that allow it to be useful at the temperatures required at both the heat accepting heat exchanger (evaporator) and the heat rejecting heat exchanger sides of the heat pump. Preferably, the refrigerant will operate in a two-phase regime in the heat accepting heat exchanger and ideally operates two-phase (subcritical) or supercritical in the heat rejecting heat exchanger.

Carbon dioxide appears to be the clear preferred choice for embodiments of the invention operating with the single fluid. Carbon dioxide [R-744] has been successfully used as a refrigerant. Additionally, carbon dioxide meets the requirements for a Stirling engine working gas and the above criteria. Such an embodiment of the invention is charged with a sufficient mass of carbon dioxide, which is appropriate for operation of both the Stirling engine and the heat pump. Since carbon dioxide has previously been used by the prior art as a heat pump refrigerant and meets the requirements for a Stirling engine working gas, the appropriate quantities for each are known to those skilled in the art. As will be seen from a discussion of the operation in the preferred embodiment of the invention, the Stirling engine operates at an average bounce space pressure equal to the pressure of the low side or heat accepting heat exchanger evaporator side of the heat pump. Since free piston Stirling engines run most effectively at pressures between 20 bar and 50 bar, the designer would prefer to select a low side operating pressure for the heat pump within that range.

In embodiments of the invention using only a single fluid, preferably carbon dioxide, the separator 70 can be omitted and the fluid conducting passage which converts the refrigerant flow path in communication with a Stirling engine space can be connected to the evaporator or downstream of the evaporator. It is preferably connected above the liquid level in the evaporator. This provides a fluid return path to return fluid which leaks past the compressor piston and maintains fluid equilibrium in both the Stirling engine and the heat pump at the low side pressure of the heat pump.

Preferably, at least two fluids are used in embodiment of the present invention. Most preferred is the use of carbon dioxide as the refrigerant and helium as the Stirling engine working gas. The use of two fluids permits one fluid to be selected for efficiency of operation of the Stirling engine and the other fluid to be selected for the efficiency of operation of the heat pump. Carbon dioxide is an excellent refrigerant. Helium has been used as a working gas for Stirling engines and the combination of helium and carbon dioxide meet the minimum criteria described above and additionally provide for highly efficient operation of both the Stirling engine and the heat pump. Small amounts of carbon dioxide that will inevitably mix with the helium and pass into the Stirling engine 2 will be entirely in the vapor state at any of the temperature and pressure conditions encountered within the free piston Stirling engine. Therefore, the engine will easily be able to operate effectively with such a helium rich but carbon dioxide containing, gas mixture. Furthermore, the helium will readily separate from the carbon dioxide within the separator at any reasonable operating condition of the heat pump.

Other refrigerants may be used, however, preferably in combination with helium. They must meet the above criteria of being a gas or vapor at any temperature and pressure condition within the Stirling engine and must be able to effectively operate as a refrigerant, that is, capable of changing phase between vapor phase and either liquid or supercritical phase at the operating pressures and temperatures of the heat pump. Since a typical Stirling engine operates at a pressure of at least 20 bar, and the heat rejecting temperature of the Stirling engine is ordinarily at least 30° C., a refrigerant used in the present invention must be gaseous above the minimum point of 20 bar pressure and 30° C.

There are other refrigerant fluids which meet the requirements for the present invention. These include trifluoromethane (R-33), which would run trans-critical for home heating. However, it is believed that this would not operate as well as carbon dioxide. Methane (R-50) would only be acceptable, operable or desirable for very low temperatures, around −90° C. Ethane (R-170) can be used for home heating and cooling, but is flammable. Ethylene (R-1150) is flammable, but can be used for cooling below 5° C. for uses such as food preservation. However, a combination of helium and carbon dioxide is believed to be far superior to other fluids because they provide known highly efficient operation of the Stirling engine, known highly efficient operation of the heat pump, and present no environmental hazard since both are naturally present in the atmosphere.

For the use of helium and carbon dioxide, the Stirling engine is designed and charged with helium to operate within the typical pressure operating range of a free piston Stirling engine, ordinarily between 20 bar and 50 bar. Preferably, the quantity of helium would be increased to provide a small excess above the quantity desired for operating the Stirling engine, for example, in an amount of 10% excess or less. The heat pump is designed to operate so that its low pressure side is equal to the average operating pressure of the Stirling engine. The heat pump is charged with sufficient carbon dioxide to operate it under these conditions. Obviously, the quantity or mass of charge is dependent upon the volume and other design parameters of the Stirling engine and heat pump as known to those skilled in the art. By way of example, a heat pumping system embodying the present invention may be charged to a pressure of 44 bar and would typically operate at 45 bar in the heating mode and 47 bar in the cooling mode, since the helium pressure would increase at operating temperature.

In the operation of the embodiment of the invention in the heating mode, as illustrated in FIG. 1, the power output from the Stirling engine system 12 directly drives the compressor piston 54. The compressor 52 compresses gas in the refrigerant flow path 40, which contains mainly carbon dioxide, but, in the steady state operation, will also contain some helium, primarily helium which leaks between the compressor piston 54 and the cylinder 56. The compressor 52 pumps the fluid into the heat rejecting heat exchanger 42, where heat is rejected in the ordinary manner of operation of a vapor compression system. The fluid in the heat rejecting heat exchanger 42 may be subcritical carbon dioxide condensation or supercritical carbon dioxide because the heat pump may operate either in the Rankine cycle, or, if heat rejection occurs at a sufficiently high temperature, as a trans-critical cycle. The fluid then passes through the expansion valve 44, which, as can be seen by the arrow direction, operates as an expansion valve in that flow direction. Downstream of the expansion valve 44, the fluid expands at approximately constant enthalpy and passes through fluid conducting line 74 into the separator 70.

In the heating mode of operation, the fluid conducting line 74 operates as a mixed phase input to the separator 70 from the refrigerant flow path. The nature of the carbon dioxide cycle is such that the carbon dioxide will be almost completely condensed to a liquid state within the separator. The helium, however, will remain in gaseous form, and therefore will bubble up and separate from the liquid carbon dioxide within the separator 70. The helium therefore passes through the gas phase outlet 78 of the separator 70, where it is returned through the fluid conducting passage 80 into the bounce space 28 of the Stirling engine 2. By connecting the fluid conducting passage 80 to return the helium to the free piston Stirling engine bounce space, the free piston Stirling engine working pressure will be essentially at the suction pressure of the compressor. This is the operating pressure of the free piston Stirling engine. Consequently, the carbon dioxide liquid, in the liquid containing portion 76 of the separator 70, will be almost entirely free of helium and will pass through the fluid conducting line 72, operating as a liquid phase output from the separator 70, through the substantially unimpeded expansion valve 46 into the heat accepting, heat exchanger (evaporator) 48, where it is free to evaporate and accept heat in the conventional manner.

In this manner, a working gas rich gas, e.g. a helium rich gas, is returned to the Stirling engine, while a carbon dioxide rich liquid is continued along the refrigerant flow path into the heat accepting, heat exchanger 48. After the liquid carbon dioxide enters the heat accepting, heat exchanger 48 and evaporates to accept heat, it then travels along the suction line 82 to the compressor 52 where it is compressed and then flows to the heat rejecting heat exchanger 42 to repeat the cycle in the usual manner.

Thermodynamic improvements of the type already known to those skilled in the art, such as providing a counterflow heat exchanger to provide suction line cooling, is a common practice and may be applied to the present invention.

Because embodiments of the invention accept heat at one heat exchanger and reject head at the other heat exchanger, embodiments may be used in either the heating mode or cooling mode without the necessity of the reversing valve 50. If used for cooling it is apparent that the mass to be cooled must be located in thermal contact with the heat accepting heat exchanger 48, and if used for heating the mass being heated must be in thermal contact with the heat rejecting heat exchanger 42. However, as known to those skilled in the art, because heat pumps are used for home heating and cooling, it is desirable to provide the reversing valve 50 so that the direction of refrigerant flow may be reversed, rather than attempting to reverse the heat exchangers or the masses in thermal contact with them. The use of a flow reversing valve in a vapor compression heat pump is known to those skilled in the art and used for the conventional reasons.

Figure 2:
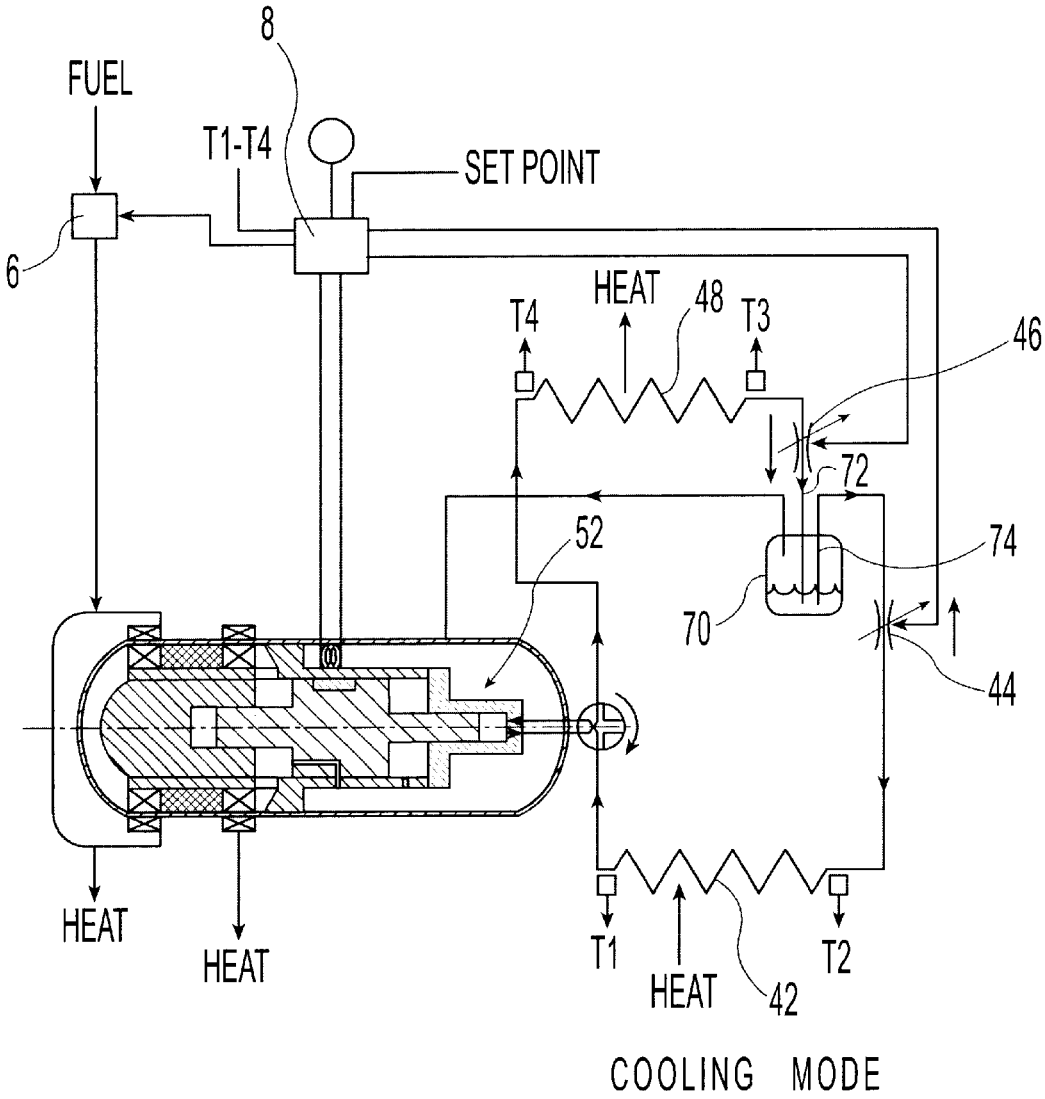
FIG. 2 is a schematic diagram of the preferred embodiment of the invention with the refrigerant flow direction reversed from the direction in FIG. 1 so that it is operating in the cooling mode.

FIG. 2 illustrates the identical apparatus as that illustrated in FIG. 1, differing from FIG. 1 only by the 180° reversal of the flow reversing valve 50, so that the compressor 52 forces refrigerant fluid flow in the reverse direction through the endless refrigerant flow path 40. In the cooling mode of FIG. 2, cooling is accomplished by the absorption of heat at the heat exchanger 42, operating in FIG. 2 as a heat accepting heat exchanger. The function of the heat exchanger 48 is also reversed so that it operates in the cooling mode of FIG. 2 as a heat rejecting heat exchanger 48. Additionally, in the cooling mode of FIG. 2, the expansion valve 44 receives flow in its reverse direction so its flow is unimpeded and it operates as a simple conduit. However, expansion valve 46 now receives flow in its forward direction so that it operates as a controllable expansion valve. The separator 70 operates identically as in the heating mode, except that its fluid conducting lines 72 and 74 have interchanged their liquid input and output roles.

In the cooling mode of FIG. 2, for a typical embodiment of the invention applied to home heating, the heat pump would operate between a higher temperature on the heat rejection side, of 20° C. for example if heat rejection is to ground water, and would operate at 12° C., for example, at the heat accepting heat exchanger for cooling air. As in the heating mode of FIG. 1, the controller 8 still controls the fuel metering valve 6, but controls the expansion valve 46 for metering refrigerant flow in the heat pump, rather than controlling the expansion valve 44.

It should therefore now be apparent that only one of the expansion valves 44 and 46 is used as an expansion valve for each mode, but a different one is used for each mode. Therefore, if flow reversal is not used, as described above, only one expansion valve is needed.

Furthermore, if flow reversal is eliminated and a single expansion valve is used as described above, the gas separator can be integrally formed in or as a part of the evaporator so that there would be no separate gas separator. Separation of the helium will occur in the evaporator and the fluid conducting passage will be connected from the evaporator to the bounce space of the Stirling engine to return the helium rich gas to the Stirling engine.

Embodiments of the invention may be controlled by applying control principles known to those skilled in the prior art. Electrical energy may be taken from the coil of the linear motor/alternator 34 of a type illustrated in U.S. Pat. No. 4,602,174 to Redlich, and applied to a storage battery for supplying electrical power to the electronic circuit of the controller 8 and to the valves. The amplitude of the free piston Stirling engine may be controlled by many of the known amplitude and power control systems.

Control of whichever expansion valve is metering refrigerant is preferably accomplished by superheat control. Minimizing the superheat at the exit of the evaporator maximizes the heat pump COP. The temperature across the heat exchanger that is operating as the heat accepting heat exchanger (evaporator) is measured by temperature sensors T1 or T2 in the cooling mode or temperature sensors T3 and T4 in the heating mode. A conventional feedback control system may be used having a set point for that temperature differential, set at a minimum for effective use of the evaporator, such as a few degrees to insure that the refrigerant has evaporated entirely. When the temperature differential across the evaporator exceeds the temperature differential set point, the expansion valve is opened to permit an increase in the flow of refrigerant to reduce the superheat. Similarly, if the temperature differential is less than the set point (or a set point range to avoid oscillation), then the expansion valve closes somewhat to reduce refrigerant flow so that superheat increases. This expansion valve control should work independently from the main temperature controls in the system and is designed to insure that the expansion valve is properly set for the operating conditions of the system.

The temperature control system for the space that is being heated or cooled operates as a conventional feedback control system which increases or decreases the drive applied to the heat pump by the Stirling engine. This is done by varying the heat input to the Stirling engine, or varying the piston or displacer amplitude using known Stirling engine principles. The heat input to the Stirling engine 2 is controlled, for example, by control of the fuel metering valve 6.

It is possible that gas separation can be accomplished on the high pressure side of the vapor compression heat pump. That may be done with the high pressure side operating within the two phase, subcritical region so that any Stirling working gas, such as helium, can be separated. If the heat pump is operating trans-critical, so that carbon dioxide is supercritical on the high pressure side of the heat pump, the carbon dioxide does not liquify and separation of the Stirling working gas would be difficult. This is not a preferred system in part because trans-critical operation is quite probable in carbon dioxide systems, especially when the temperature of the high pressure side is so high that the carbon dioxide is supercritical.

A system can also have the leakage past the compressor piston in a direction which is the reverse of that described above. In such a system, the leakage flow would be from the heat pump into the Stirling engine working space. In that event, the fluid conducting passage connecting the refrigerant flow path in communication with at least one space of the engine spaces will conduct return fluid from the Stirling engine, such as from the bounce space, back into the refrigerant flow path to maintain equilibrium of the system. More specifically, this return path would be directed to a gas separator, or as described above to the evaporator acting also as a separator. When such return gas reaches the separator, the carbon dioxide will condense and the helium will rise. Because of the continuous condensation of the carbon dioxide, the partial pressure of the carbon dioxide will be lower in the separator so the carbon dioxide will migrate through the return path to the refrigerant flow path. The helium will be the same in both the Stirling engine and in the refrigeration flow path and therefore it will dissociate through the return path, so that a helium rich mixture will return to the Stirling engine. Consequently, there will be an average migration of carbon dioxide into the refrigeration flow path and of the helium back into the Stirling engine.

Using real, established, component performance numbers, it is possible to estimate the overall performance of the system in heating and cooling modes.

Figure 3:
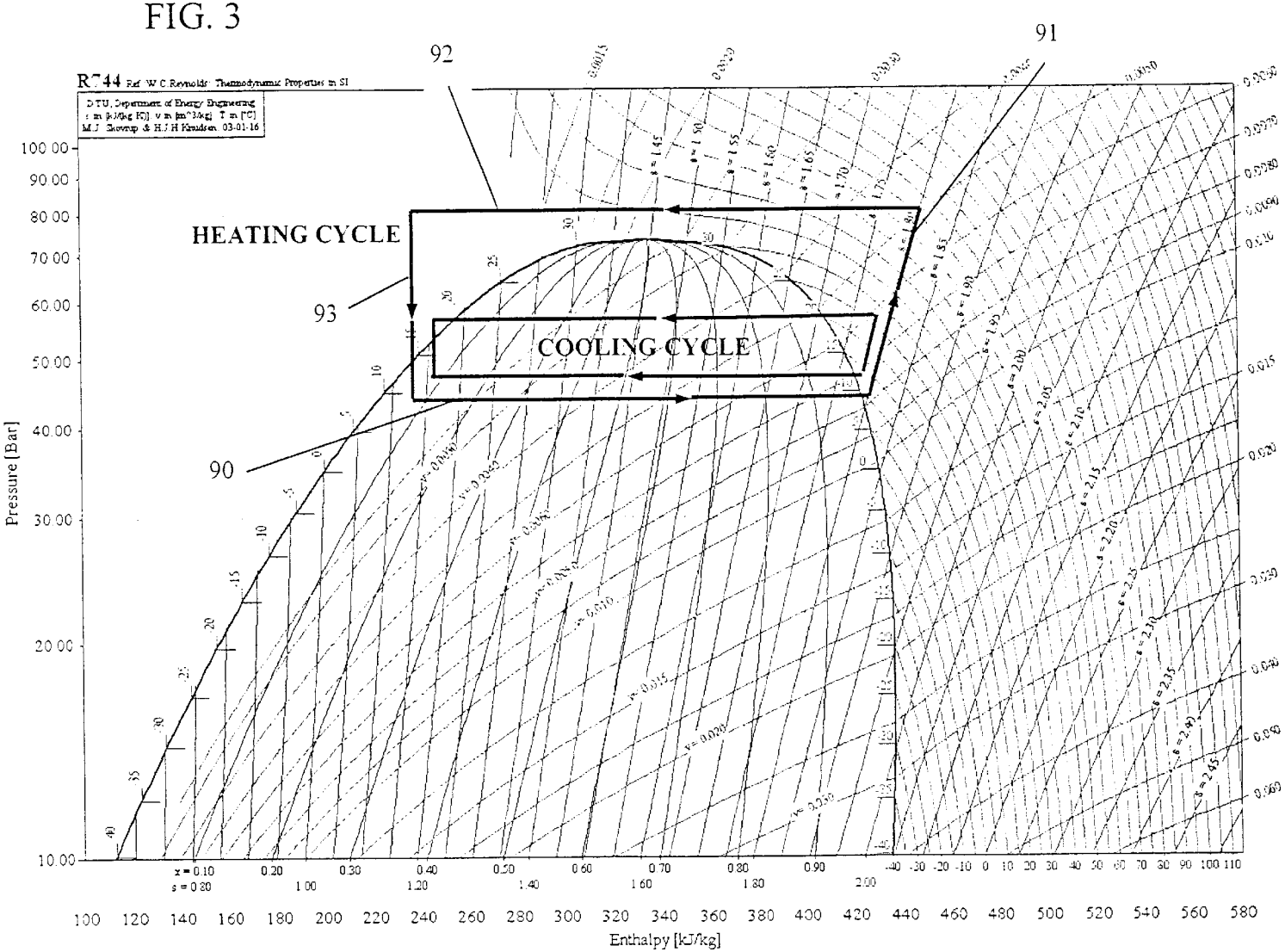
FIG. 3 is a graph illustrating both the heating cycle and the cooling cycle of the preferred embodiment of the invention.

In the heating mode, typical component performance numbers are: Burner efficiency ($\eta_b$)≈0.80, FPSE efficiency ($\eta_e$)≈0.30. If the heat pump 4 heat source is ground water, e.g. at a temperature of 10° C. and the heat rejecting heat exchanger 42 operates at e.g. 35° C., it is not unreasonable to expect a heating COP ($COP_h$)≈6.0 or better. In this case the heat pump is operating trans-critical as can be seen in FIG. 3, heating mode processes 90 (heat acceptance/evaporation)—91 (compression)—92 (heat rejection)—93 (expansion). Assuming one unit of input energy to the burner 30, the burner would reject 0.2 units of heat, the free piston Stirling engine 2 would produce 0.8×0.3=0.24 units of work energy and would reject 0.8−0.24=0.56 units of heat energy. The heat pump is driven by 0.24 units of work energy and rejects 6.0×0.24=1.44 of heat energy. The total heating energy of the system is then 0.2+0.56+1.44=2.20 units of heat energy for each single unit of input energy from the fuel. Since hydrocarbon fuel is usually much cheaper per unit of energy than electricity, the overall savings in operating costs is substantial.

In the cooling mode, the heat pump cooling COP ($COP_c$) ≈18.0 giving an overall cooling effect of 0.24×18.0=4.32 units of energy per single unit of input energy. In addition, the total rejected heat of 0.2+0.56=0.76 units is available for water or other heating, if needed. The system therefore saves energy in all seasons (heating mode in winter and cooling mode in summer) and substantially reduces operating costs.

From the above description it can be seen that the invention is a method for pumping heat from a cooler mass to a hotter mass using a free piston Stirling engine driving a heat pump. The heat pump has a compressor, an endless refrigerant fluid flow path containing a refrigerant fluid, and the Stirling engine contains a working fluid. The method comprises enclosing the Stirling engine and the compressor in a common, hermetically sealed enclosure and then effecting the flow of at least a component of the fluid between the refrigerant flow path and the Stirling engine. Although carbon dioxide alone may be used, preferably the fluids include carbon dioxide and helium and the method further comprises separating the fluid into a carbon dioxide rich component and a helium rich component and then effecting the flow of the helium rich component into the Stirling engine and the carbon dioxide rich component through the heat pump flow path. Preferably, the separation of these components follows expansion of the refrigerant in the refrigerant flow path. However, they may also be separated following compression in the refrigerant flow path, preferably after the condenser.

While certain preferred embodiments of the present invention have been disclosed in detail, it is to be understood that various modifications may be adopted without departing from the spirit of the invention or scope of the following claims.

What is claimed is:

1. An improved heat pumping machine having a Stirling engine driving a heat pump, the heat pump having a refrigerant fluid contained in an endless flow path including a compressor, a heat rejecting heat exchanger, an expansion valve and a heat accepting heat exchanger, the Stirling engine having a space containing a working fluid, the improvement comprising:

(a) the engine mechanically linked to the compressor inside a hermetically sealed enclosure which encloses both the engine and the compressor; and (b) a fluid conducting passage connecting the refrigerant flow path in communication with said space containing the working fluid.

2. A machine in accordance with claim 1 wherein the Stirling engine is a free piston Stirling engine.

3. A machine in accordance with claim 2 wherein said fluids consist essentially of carbon dioxide.

4. A machine in accordance with claim 2 wherein said fluids include carbon dioxide.

5. A machine in accordance with claim 2 wherein (a) said fluids include: helium working gas and a refrigerant selected from at least one of the group consisting of carbon dioxide, trifluorometame, methane, ethane, and ethylene; and (b) the machine includes a gas/liquid phase separator interposed in the refrigerant flow path, the separator having a mixed phase input connected to the flow path for receiving fluid, a liquid phase output connected to the flow path for returning refrigerant rich liquid to the flow path and a gas phase outlet connected to said passage for supplying working gas rich gas to the Stirling engine.

6. A machine in accordance with claim 5 wherein the mixed phase input of the separator is connected downstream of the expansion valve and the liquid phase output is connected upstream of the heat accepting heat exchanger.

7. A machine in accordance with claim 6 wherein the fluid conducting passage connects in fluid communication with the bounce space.

8. A machine in accordance with claim 7 wherein said fluids consist essentially of helium and carbon dioxide.

9. A machine in accordance with claim 8 wherein the Stirling engine includes a power piston integrally formed with a compressor piston in said compressor, the power piston having a diameter greater than the diameter of the compressor piston.

10. A machine in accordance with claim 9 wherein:

(a) said machine further includes a second expansion valve interposed in the refrigerant flow path, each machine expansion valve being a forward-expanding, reverse unimpeded expansion valve, the valves being connected in the refrigerant flow path between the heat exchangers and in opposite directions so that, for flow in either direction, one valve operates as an expansion valve and the other is substantially unimpeded;

(b) said separator includes a pair of fluid conducting lines connecting the expansion side of each expansion valve with a liquid contain portion of the separator; and (c) a flow reversing valve connects the refrigerant flow path to the compressor.

11. A machine in accordance with claim 10, wherein the expansion valves are controllably variable, for controlling the refrigerant flow rate.

12. A machine in accordance with claim 2 wherein said fluids consist essentially of helium and carbon dioxide.

13. A machine in accordance with claim 2 wherein the Stirling engine includes a power piston integrally formed with a compressor piston in said compressor, the power piston having a diameter greater than the diameter of the compressor piston.

14. A machine in accordance with claim 13 wherein:

(a) said flow path further includes a second expansion valve, each expansion valve being a forward-expanding, reverse unimpeded expansion valve, the valves being connected in the refrigerant flow path between the heat exchangers and in opposite directions so that, for flow in either direction, one valve operates as an expansion valve and the other is substantially unimpeded;

(b) the machine includes a gas/liquid phase separator having a pair of fluid conducting lines connecting the expansion side of each expansion valve in fluid communication with a liquid containing portion of the separator, the separator also having a gas phase outlet connected to said passage for supplying working gas rich gas to the Stirling engine; and (c) the machine includes a flow reversing valve connecting the refrigerant flow path to the compressor.

15. A machine in accordance with claim 14, wherein the expansion valves are controllably variable, for controlling the refrigerant flow rate.

16. A machine in accordance with claim 14 wherein said fluids include helium working gas and carbon dioxide refrigerant.

17. A machine in accordance with claim 16 wherein said fluids consist essentially of helium and carbon dioxide.

18. A machine in accordance with claim 2 wherein:

(a) said flow path further includes a second expansion valve, each expansion valve being a forward-expanding, reverse unimpeded expansion valve, the valves being connected in the refrigerant flow path between the heat exchangers and in opposite directions so that, for flow in either direction, one valve operates as an expansion valve and the other is substantially unimpeded;

(b) the machine includes a gas/liquid phase separator having a pair of fluid conducting lines connecting the expansion side of each expansion valve in fluid communication with a liquid containing portion of the separator, the separator also having a gas phase outlet connected to said passage for supplying working gas rich gas to the Stirling engine; and (c) a flow reversing valve connects the refrigerant flow path to the compressor.

19. A machine in accordance with claim 18, wherein the expansion valves are controllably variable, for controlling the refrigerant flow rate.

20. A method for pumping heat from a cooler mass to a hotter mass using a free piston Stirling engine driving a heat pump, the heat pump including a compressor and an endless refrigerant fluid flow path containing a fluid, the Stirling engine containing a working fluid, the method comprising:

(a) enclosing the Stirling engine and the compressor in a hermetically sealed enclosure; and (b) effecting the flow of at least a component of a said fluid between the refrigerant flow path and the Stirling engine.

21. A method in accordance with claim 20 wherein the fluids include carbon dioxide and helium and the method further comprises separating the fluid into carbon dioxide rich and helium rich components and effecting the flow of the helium rich component into the Stirling engine and the carbon dioxide rich component through the heat pump flow path.

22. A method in accordance with claim 21 wherein the components are separated following expansion of the refrigerant in the refrigerant flow path and the helium rich component fluid is directed into the Stirling engine and the carbon dioxide rich component is directed through the refrigerant flow path.

* * * * *